US009117558B1

(12) United States Patent
Pennington

(10) Patent No.: US 9,117,558 B1
(45) Date of Patent: Aug. 25, 2015

(54) SYSTEM AND METHOD TO CONTROL SPENT NUCLEAR FUEL TEMPERATURES

(75) Inventor: Charles W. Pennington, Alpharetta, GA (US)

(73) Assignee: NAC INTERNATIONAL, INC., Norcross, GA (US)

( * ) Notice: Subject to any disclaimer, the term of this patent is extended or adjusted under 35 U.S.C. 154(b) by 584 days.

(21) Appl. No.: 13/419,578

(22) Filed: Mar. 14, 2012

Related U.S. Application Data

(60) Provisional application No. 61/479,082, filed on Apr. 26, 2011.

(51) Int. Cl.

| | |
|---|---|
| ***G21C 19/00*** | (2006.01) |
| ***G21F 5/10*** | (2006.01) |
| *G21F 5/00* | (2006.01) |
| *G21F 5/06* | (2006.01) |

(52) U.S. Cl.
CPC ... *G21F 5/10* (2013.01); *G21F 5/00* (2013.01); *G21F 5/06* (2013.01)

(58) Field of Classification Search
CPC ..... G21F 5/00; G21F 5/02; G21F 5/04; G21F 5/06; G21F 5/10
USPC ..... 376/260, 272
See application file for complete search history.

(56) References Cited

U.S. PATENT DOCUMENTS

| | | | | |
|---|---|---|---|---|
| 3,073,961 | A * | 1/1963 | Nachbar et al. | 250/506.1 |
| 4,288,997 | A * | 9/1981 | Friesen et al. | 62/434 |
| 2009/0158614 | A1 * | 6/2009 | Singh et al. | 34/474 |

* cited by examiner

*Primary Examiner* — Jack W Keith
*Assistant Examiner* — Marshall O'Connor
(74) *Attorney, Agent, or Firm* — Thomas | Horstemeyer, LLP

(57) ABSTRACT

Systems and methods of the disclosure are directed toward removing moisture from, and controlling the temperature of, spent nuclear fuel stored in spent fuel containers and the containers themselves. A vacuum system may remove vapor and gas from the container to reduce pressure and stimulate moisture evaporation. The potentially radioactive gas exiting the spent fuel container can also be transported to a radioactive waste gas system. A non-reactive gas is then circulated through a circulation path, which is communicatively coupled to a spent fuel container. The non-reactive gas can absorb heat and/or moisture from the spent fuel stored within the spent fuel container. Accordingly, heat can be removed by a heat exchanger coupled to the circulation path. Condensate moisture can also be removed from the circulation path.

13 Claims, 2 Drawing Sheets

SYSTEM AND METHOD TO CONTROL SPENT NUCLEAR FUEL TEMPERATURES

CROSS-REFERENCE TO RELATED APPLICATION

This application claims priority to U.S. Provisional Application Ser. No. 61/479,082, filed Apr. 26, 2011, which is incorporated by reference herein in its entirety.

BACKGROUND

Spent nuclear fuel has historically been stored in deep reservoirs of water, called spent fuel pools, within nuclear power plants. This spent fuel storage technology is often termed "wet storage." Spent fuel pools at reactors are reaching their spent fuel capacity limits, causing concerns about the need to shut down reactors because there is no more room for the spent fuel. Dry nuclear spent fuel storage technology (termed "dry storage") is deployed throughout the world to expand the capabilities of nuclear power plants to discharge and store nuclear spent fuel external to a reactor's spent fuel pool, thereby extending the operating lives of the power plants. Two classes of technology are used in dry spent fuel storage: metal casks with final closure lids that are bolted closed at the power plants after loading with spent fuel, and concrete storage casks containing metal canisters having canister final closure lids that are welded closed or sealed with mechanical methods at the power plants following spent fuel loading. This latter dry storage technology is referred to as canister-based concrete spent fuel storage. The concrete cask serves as an enclosure or overpack structure that provides mechanical protection, heat removal features, and radiation shielding for the inner metal canister that encloses the radioactive material. The use of this technology tends to have significant capital cost and other economic advantage over the use of metal cask technology for storage.

However, for transport of spent nuclear fuel, metal casks are still the preferred technology. For dry, spent nuclear fuel transport, two fundamental classes of technology are used: (i) metal casks with final closure lids (or lid) that are bolted closed at power plants or other facilities after loading of the spent fuel into open compartments of a separate structure nested within the cask body (termed the "basket"); this technology when used for spent fuel shipment is termed "bare fuel" transport; and (ii) similar metal casks with bolted final closure lids (or lid) having the metal canister used in dry storage within the cask body, the canister containing the basket structure and the final closure lid (or lids) installed at the power plants or other facility following spent fuel loading; this technology when used for spent fuel shipment is called "canistered fuel" transport.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION OF THE DRAWINGS

Figure 1:
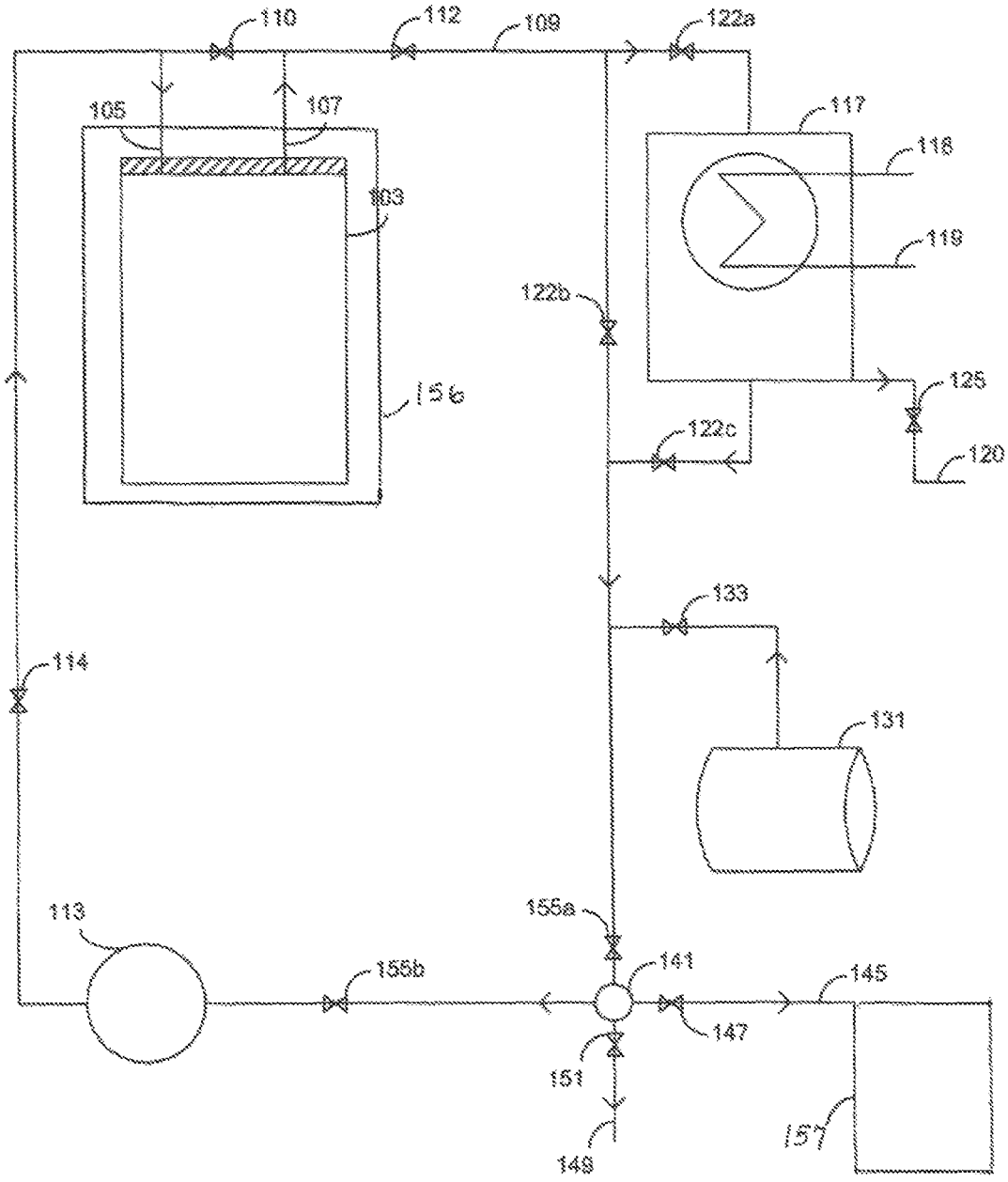
FIG. 1 is an example system for controlling the temperature of spent nuclear fuel according to various embodiments of the disclosure.

Throughout the technology considerations involving dry storage and transport of spent nuclear fuel discussed above, there is an issue that is common for each and that is of prime importance in assuring the long term integrity of the casks and canisters, as well as the spent nuclear fuel in dry storage or during transport. That consideration is the drying process for the fuel and containers that must be performed prior to the final closure of the canister or the metal cask at the power plant. Arriving at a condition within the spent fuel container (cask or canister) where all moisture below a specified minimum value has been removed is a most important step for the long term integrity of the container and the spent fuel. The process to accomplish this involves a careful balance of moisture removal and heat removal from the spent fuel container so that the cladding of the spent fuel is not subject to elevated temperatures or temperature cycling that may result in cladding degradation and a limitation on that cladding's structural stability, a critical characteristic that is determinative of its long term integrity.

Over the last four decades, the process that has proven itself for moisture removal from spent fuel containers has been vacuum drying. That process is still the most efficient and safest process for insuring sufficient moisture removal from spent fuel containers. However, because the nuclear fuel cycle has now advanced to a condition where spent fuel has been burned in reactors at higher uranium ($^{235}U$) enrichments and for much longer periods (as measured in terms of the megawatt-days per ton of uranium produced by the fuel) and where it is necessary to place spent fuel into dry storage or transport containers after much shorter periods of cooling, the heat generation rate (heat-rate) of the spent fuel within containers is much higher than has been the case for the last 4 decades. With such a developing situation, one of the key strengths of vacuum drying, the production of fuel heat within the container, which greatly assists in moisture evaporation, could become a liability because fuel temperatures may reach unacceptable levels, or an exclusive vacuum drying process may allow fuel temperatures to vary outside of acceptable ranges. It is, therefore, the purpose of this method to provide an integrated system of vacuum drying with ancillary features and functions that make full use of the proven and safe drying features of current systems, while integrating such features/functions with new and unique methods, systems, processes and procedures that allow vacuum drying to work at its productive best while protecting the spent fuel and enhancing the vacuum drying moisture removal.

Dry spent fuel storage and transport system designs must generally comply with governmental regulatory requirements. As part of the implementation of these requirements, regulatory bodies have issued design limitations on the allowable temperature of the spent nuclear fuel during the loading, drying, and closure of the canisters or transport casks, during the storage of the systems at the power plants, and during the transport of the spent fuel away from the plant. Drying of the spent fuel and the inside of the containers that store or transport it is a significant operational and regulatory consideration in order to assure there is little, if any, retained moisture that could produce long term degradation of the fuel or of the system that contains the fuel. When dry storage canisters and/or metal casks are being prepared for closure and moisture is being removed to dry the spent fuel in preparation for storage or transport, the regulatory requirements stipulate both a maximum allowable fuel temperature and a maximum range of temperature variation that the spent fuel is allowed to experience.

Storage and transport systems, in combination with the ancillary drying systems used to remove the moisture, are designed to limit fuel temperatures and temperature variations while still fulfilling the drying function. These temperature limits help assure that the material properties of the spent fuel cladding are maintained in a safe and predictable range. However, controlling the maximum temperature of the spent fuel and the range of its variation during fuel drying in preparation for storage or transport can become a difficult technical design task when the spent fuel has in-reactor burn up and/or post-reactor cooling period characteristics that cause it to have high heat generation rates. Such is now more often the case, as utilities are generating large amounts of spent nuclear fuel that have been exposed to longer periods in-reactor to extract more energy from the contained uranium (known as high burn up fuel), and that cannot be kept in wet storage for as long as desired because of spent fuel pool capacity or other regulatory limits.

Of the methods for drying closed spent fuel containers, vacuum drying is the foremost process having a demonstrated effectiveness over many years to achieve spent fuel and container dryness. Vacuum drying uses simple and proven systems and equipment, does not require any special or unique re-orientation of the spent fuel container, and introduces no special chemicals that might raise concerns of material interactions and integrity. For these reasons, vacuum drying is also the most widely used process for drying. Vacuum drying uses pumping systems to reduce the pressure within the closed spent fuel container system, so that, even with very low heat rates from the spent fuel, liquid water will flash to water vapor and, together with any other gases, be removed by the very system that is establishing the vacuum within the spent fuel container. In one example, the pressure can be reduced from approximately atmospheric pressure to a pressure range of a few millibars (e.g., tenths of an inch Hg, ten millibars, etc.). Dryness is also easily measured once a vacuum has been established. If the system pressure, without pumping, remains stable over a period of time, no further conversion of water to vapor is occurring and the closed system is dry. A further and unique advantage of vacuum drying is displayed when some spent fuel rods having small cracks or holes that permit water from the spent fuel pool to leak into the rods during wet storage (such rods are termed "water-logged rods") must be placed into dry storage or transported. The vacuum drying process results in a pressure differential across the spent fuel cladding of water-logged rods, that pressure differential providing the motive force to expel water from inside the rod into the container, so that it can be removed as vapor to enhance dryness within the container. In such a case, vacuum drying is important because such water-logged rods are, very often, older and colder rods that do not generate sufficient internal heat to expel the water as vapor. If they remain water-logged during dry storage or transport, the opportunity for spent fuel or container degradation through corrosion or other mechanisms, in clear violation of regulations, increases. Finally, the vacuum drying process presents no threat to the spent fuel or to the spent fuel container, since the maximum of one atmosphere of differential pressure that these fuel rods and canisters experience is far less than the normal, off-normal, and accident condition loadings for which they are designed for service in a reactor.

Other proposed drying processes that simply pump a heated gas through the container may very well fail to remove such moisture trapped in spent fuel rods because there is neither a sufficient heat source within the fuel nor a sufficient pressure differential across the fuel cladding to remove the moisture. Indeed, with a system that pumps a heated and pressurized gas through the container for drying, the increase in the pressure differential caused by the gas tends to suppress moisture vaporization in the fuel and container and to force the moisture to remain within the water-logged fuel. Further, there are other "moisture hide-out" conditions that may pertain to spent fuel and its containers that a pressurized gas drying system will have great difficulty in eliminating. These conditions include the use of damaged fuel cans within spent fuel containers and water that is trapped within spent fuel assembly guide tubes, among others.

With all the advantages of vacuum drying, its major drawback occurs when very hot spent fuel must be placed into dry storage or transported. With very hot spent fuel under vacuum, the cooling atmosphere no longer surrounds the fuel and, without a conducting medium to remove fuel heat, fuel temperatures can rise rapidly over a period of hours. Such a temperature rise threatens the operators at the power plant with exceeding both the fuel high temperature and the fuel temperature variation regulatory limits. For this reason, it is vitally important to the industry to have a modified system for drying very hot spent fuel within a container, so that proper dryness can be achieved while maintaining fuel temperatures within regulatory requirements. The method described herein achieves this outcome without compromising the very useful application and effectiveness of vacuum drying, which has been demonstrated over several decades to assure spent fuel dryness for long term material integrity and stability.

Embodiments of the disclosure facilitate proper spent fuel container dryness while controlling and limiting the fuel temperature rise that may result from using proven vacuum drying methods alone. A method according to the disclosure comprises the use of both a vacuum drying system and a non-reactive gas cooling system that works in combination with the vacuum drying system. The vacuum drying system is comprised of outlet paths and connections from the spent fuel container, vacuum drying pump or pumps, pump discharge paths and connections to radioactive liquid and gas disposal systems, other pump discharge paths and connections as well as associated piping, valving, and monitoring instrumentation.

In one embodiment, a gas cooling system according to the disclosure may be comprised of inlet paths and connections to the spent fuel container, outlet paths and connections from the spent fuel container, which may be integrated with the vacuum drying system, non-reactive gas circulating pump or pumps, which may be integrated with the drying system vacuum pump or pumps, pump discharge paths and connections to the spent fuel container and to the heat exchanger, other pump discharge paths and connections, a heat exchanger with appropriate cooling medium inlet, outlet, and moisture drain features, such heat exchanger being located in the main non-reactive gas circulation flow path and/or in a parallel path, a non-reactive gas supply and supply connection, and associated piping, valving, and monitoring instrumentation. The non-reactive gases that may be used include, but are not limited to, all inert gases (helium, argon, etc.), carbon dioxide, nitrogen, or other gases having high thermal stability with good heat transfer properties (high moisture absorption characteristics may also be considered as a valuable parameter).

Upon initiation of the container and spent fuel drying process, the heat generation rate of the spent fuel in the container is known, and fuel heat-up rates and increase in the resulting temperatures of the spent fuel have been calculated based upon the design conditions of the container. Typically, this disclosed drying method will be used with spent fuel containers having contained fuel heat rates in the range of 25 kW to 45 kW, although with lower or higher container heat rates, the method can still be applied effectively. With the spent fuel and container heat rates and temperatures known from calculation or measurement, an initial vacuum is drawn on the system, which begins the removal of moisture. Because of a fuel clad temperature variation range limitation of approximately 50° C. to 100° C., or because of a peak spent fuel clad temperature limit that can range from approximately 250° C. to 400° C., depending on fuel or regulatory restrictions, the initial drying period will be predetermined, based upon the temperature of the spent fuel in the container at vacuum drying initiation and the heat generation rate of the spent fuel. This period will typically be less than 10 hours, but vacuum drying continues until both the calculated fuel temperature and the range of fuel temperature increase after the initial period of vacuum drying reach pre-determined values based upon the initial conditions. When vacuum drying is stopped, gas cooling is initiated by back-filling the system with a non-reactive gas at approximately atmospheric or somewhat higher pressure and using the cooling system pump or pumps to circulate the gas through the spent fuel container. For purposes of meeting regulatory non-condensable/corrosive gas limitations in the canister, the non-reactive gas should meet chemical gas purity standards or have impurities typically totaling less than 0.5%, depending on the impurity(ies). A spent fuel container, with the internal spent fuel basket and the rod-and-grid array of the spent fuel assemblies, makes a desirable arrangement for a typical tube-and-shell heat exchanger to remove spent fuel heat, thereby providing excellent control of both fuel temperature peaks and ranges of variation.

If the fuel container is generating heat above a rate that requires other than ambient cooling of the non-reactive gas in the cooling circuit (typically less than 30 kW), the non-reactive gas heat exchange system may also be used, and cooling water flow to the heat exchanger will be started. As with heat-up, the fuel temperature range must also be controlled during cool-down with the non-reactive gas, and this will be done by calculation using the parameters of the fuel, container, and drying system previously discussed. As the gas circulates through the spent fuel container, it removes heat from the fuel and, as the gas is heated by the spent fuel, it can also absorb moisture from the spent fuel container. The circulating gas primarily serves the purpose to cool the spent fuel in the container, and the gas is cooled by the heat exchanger, thereby allowing the fuel temperature to be controlled by the gas flow rate appropriate for the wide range of possible spent fuel loading conditions and the amount of sub-cooling established by the heat exchanger, based upon pre-determined levels established by calculation. An ancillary feature of the gas chilling function performed by the heat exchanger (as with even a simple air-conditioning system) is that the moisture from the spent fuel container retained by the heated, non-reactive gas will condense and be removed from the gas in the heat exchanger while the fuel temperature is being stabilized at a pre-determined level.

Once the spent fuel and gas have achieved a condition of homeostasis at the desired temperature within the range of approximately 250° C. to approximately 400° C. and within the accepted range of temperature variation of approximately 50° C. to 100° C., as determined by gas flow rate and spent fuel container inlet gas temperature, gas cooling period, spent fuel heat generation rate, and spent fuel container outlet gas temperature, then gas cooling may be stopped and vacuum drying may be resumed. This drying and heat removal process cycle may be repeated as desired, and a vacuum dryness testing process (e.g., the pressure rise in the spent fuel container over a given period when isolated from vacuum drying as a result of additional moisture evaporating into the vapor state) may be performed at any time. With proper management of multiple cycles of drying and heat removal, sufficient dryness while assuring the regulatory limits of spent fuel temperature or temperature variation can be achieved because the non-reactive gas cooling system may always be relied upon for a specified period of time to actually control the spent fuel temperatures and range of variation so that additional drying and heat removal cycles can be performed until proper dryness is achieved.

The method for use of the combined vacuum drying and heat removal systems can utilize a known heat generation rate of the spent fuel within the container, the approximate initial temperature of the spent fuel before the initiation of vacuum drying, the inlet temperature and the flow rate of non-reactive gas through the spent fuel container, and the spent fuel container non-reactive gas outlet temperature. These parameters may all be measured or conservatively calculated as part of the procedures to implement the method. All resulting system conditions and parameters can be conservatively calculated on the basis of known initial conditions and procedures that vary in accordance with these known initial conditions may be established based upon such calculations so that proper spent fuel container dryness with spent fuel temperatures remaining in compliance with regulatory directions is assured.

Accordingly, FIG. 1 shows one embodiment of a system 100 according to the present disclosure. In the embodiment shown in FIG. 1, spent fuel (e.g., spent nuclear fuel) is disposed within a spent fuel container 103. In an embodiment, the spent fuel container further comprises a spent fuel canister 156 disposed within another cask used to handle the canister. The spent fuel within the spent fuel container 103 can initially be allowed to reach a pre-determined temperature in a non-reactive gas, the temperature being approximately that of normal operation for the heat generation rate of the spent fuel once it is in dry storage or in transport. Such a temperature would typically be in the range of approximately 150° C. to approximately 300° C. In many embodiments, the pre-determined temperature can be one that permits a container temperature that causes vaporization of residual moisture within the spent fuel container. The spent fuel container 103 is also coupled to at least one inlet path 105 as well as at least one outlet path 107, which communicatively couple the spent fuel container 103 to a circulation path 109 typically comprising a high quality metal that is corrosion, diffusion and leakage resistant (e.g., stainless steel), ceramic, or other high integrity material that is configured to circulate a non-reactive gas among the various components of the system. The circulation path 109 can be communicatively coupled to the various components of the depicted system 100 and permit the flow of gas between the various components as depicted in the non-limiting example of FIG. 1. The depicted system 100 can also include a spent fuel container bypass valve 110 that can substantially isolate the spent fuel container from the circulation path 109. Additionally, the circulation path 109 can include one or more shutoff valves 112 that can cause circulation of gas through the circulation path 109 to cease.

At least one circulation pump 113, when the system is in a vacuum drying mode, can be used to cause a reduction of pressure within the spent fuel container 103 as well as the rest of the circulation path 109 relative to the atmosphere. In some embodiments, the circulation pump 113 can cause nearvacuum conditions within the spent fuel container 103 and/or the circulation path 109. The reduction of pressure within the spent fuel container in the vacuum drying mode 103 can cause moisture extraction from the spent fuel within the spent fuel container and from the container itself. Additionally, when the circulation pump is used for non-reactive gas cooling of the spent fuel, the non-reactive gas absorbs heat from the spent fuel.

Accordingly, a heat exchanger 117 coupled to the circulation path 109 is configured to remove heat from the gas exiting the spent fuel container 103. Therefore, the heat exchanger 117 can be coupled to a cooling inlet 118 as well as a cooling outlet 119 for circulation of a coolant through the heat exchanger. The heat exchanger 117 can also be coupled with a liquid waste removal system that can remove potentially radioactive waste liquids from the gas exiting the spent fuel container 103 via a liquid waste outlet 120. The circulation path 109 can also be configured with a heat exchanger bypass valve system 122 that can be configured to isolate the heat exchanger from the circulation path 109 if necessary. The liquid waste outlet 120 can likewise be configured with a liquid waste shutoff valve 125 to isolate the liquid waste outlet 120 from the heat exchanger 117.

During a subsequent cooling mode, a non-reactive gas source 131 coupled to the circulation path 109 to provide the non-reactive gas circulating throughout the system 100. The non-reactive gas source would typically be pressurized to a value in the range of 100 psig or greater in order to supply the volume of gas desired for system and container backfill and system flow rates. In one embodiment, such a source would be typically provided as bottled-gas that may be replaced when empty. Further, as noted above for the vacuum drying mode, the circulation pump 113 can cause a reduction of pressure within the circulation path 109 relative to the atmosphere. Accordingly, such a pressure differential can draw the non-reactive gas from the container and circulation system at the re-initiation of vacuum drying and discharge that gas to a radioactive waste gas system or through a vent to another storage (tanks or similar) system for use during the next gas cooling mode. A non-reactive gas shutoff valve 133 can also be provided, which can isolate the non-reactive gas source 131 from the circulation path 109.

A four-way flow splitter 141 (e.g., a four-way splitter ball valve) can also be employed that is coupled to the circulation path 109 to facilitate enhancement of non-reactive gas flow rates or to supplement moisture extraction rates during vacuum drying. A shutoff valve system 155 can isolate the four-way splitter 141 from the circulation path 109 as well as halt circulation of gases through the circulation path 109. A radioactive waste gas outlet 145 can also be coupled to the circulation path 109 to remove any radioactive waste gases that may persist in the gas exiting the spent fuel container 103 from the circulation path during vacuum drying, prior to starting recirculation of the non-reactive gas to the at least one inlet path 105 coupled to the spent fuel container 103. In an embodiment, a radioactive waste gas disposal system 157 is coupled to the circulation path, the radioactive waste gas disposal system configured to remove radioactive waste gas from the circulation path. Such disposition of potentially radioactive gases from within the spent fuel container into a power plant's radioactive waste gas system is a typical operation for the management of plant radioactive waste. A radioactive waste gas outlet shutoff valve 147 can isolate the radioactive waste gas outlet from the circulation path 109. The circulation pump(s) may also be coupled to a venting system 149 for storing (recycling) of non-reactive gas from one cooling cycle to the next, and a venting shutoff valve 151 can isolate the venting system from the circulating pump(s). In some embodiments, an additional circulation pump 161 can be employed. In various embodiments, a first pump can be employed for vacuum drying and a second pump for gas recirculation flow throughout the system.

Figure 2:
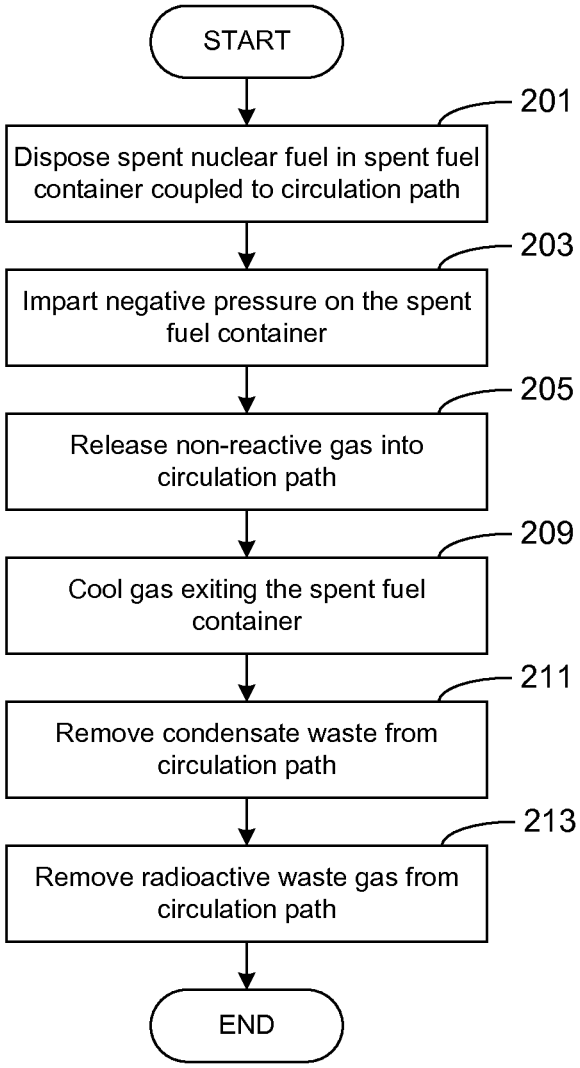
FIG. 2 is an example method for controlling the temperature of spent nuclear fuel according to various embodiments of the disclosure.

A method using vacuum drying combined with non-reactive gas cooling of hot spent nuclear fuel in dry storage and transport containers can allow operators of such systems to meet regulatory fuel temperature requirements while achieving proper spent fuel container dryness using the most efficient and proven vacuum drying systems and methods. FIG. 2 illustrates a flowchart that depicts one example of a method according to an embodiment of the disclosure. The method illustrated in FIG. 2 can be implemented in a system according to the present disclosure.

First, in box 201, spent nuclear fuel can be disposed or stored in a spent fuel container that is coupled to a circulation path. As noted above, a spent fuel container can comprise a canister with a closure lid that can, in turn, be disposed in a storage and/or transport cask. In box 203, a negative pressure can be imparted on the spent fuel container. In some embodiments, a negative pressure can be generated by a vacuum pump and/or recirculation pump that is coupled to the circulation path. In box 204, gas can be discharged from the spent fuel container to a radioactive waste gas system and/or vent. Next, in box 205, a non-reactive gas can be released and/or injected into the spent fuel container and/or the circulation path. In box 209, a gas exiting the spent fuel container can be cooled by a heat exchanger or other apparatus to remove heat from the gas. In box 210, the non-reactive gas can be circulated through the recirculation path. The circulation of the non-reactive gas can facilitate the controlling and/or modulation of temperature levels in the spent fuel container. In box 211, vacuum drying of the spent fuel container can be resumed. In box 212, condensate waste can be removed from the system. In some embodiments, condensate waste may be radioactive in nature and thus properly disposed of.

Finally, it should be noted that commercial spent nuclear fuel has been generated and accumulated for more than 50 years at power plants in the U.S. That means there is an extensive variation in fuel design, heat generation rates, cooling periods, materials of fabrication, uranium enrichments, burn-ups, and other parameters that all play significant roles in establishing the design characteristics of the subject method. Where typical values are provided, it must be understood that the large variation in commercial spent nuclear fuel designs, materials, and radioactive decay periods means there will also be a number of method and system approaches that will be outside the typical ranges provided herein.

Although the flowchart of FIG. 2 shows a specific order of execution, it is understood that the order of execution may differ from that which is depicted. For example, the order of execution of two or more blocks may be scrambled relative to the order shown. Also, two or more blocks shown in succession in FIG. 2 may be executed concurrently or with partial concurrence. Further, in some embodiments, one or more of the blocks shown in FIG. 2 may be skipped or omitted.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to significant figures of the numerical value. In addition, the phrase "about 'x' to 'y'" includes "about 'x' to about 'y'". Additionally, where components of embodiments of the disclosure are shown and/or discussed as being coupled, communicatively coupled and/or connected to one another, it should be appreciated that these components may not be in direct coupling to one another, and that intermediary components or elements can be employed between the coupled components.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The invention claimed is:

1. A system, comprising:

a spent fuel container coupled to at least one inlet path and at least one outlet path, the at least one inlet path configured to transport a non-reactive gas into the spent fuel container, the at least one outlet path configured to transport potentially radioactive vapor and gas from the spent fuel container, the at least one inlet path and at least one outlet path further coupled to a circulation path;

at least one circulation pump coupled to the circulation path, wherein the at least one circulation pump comprises a vacuum circulating pump when the system is operating in a vacuum drying mode, and a gas circulating pump when the system is operating in a cooling mode, the vacuum circulating pump configured to remove vapor and other gases from the container and transport the vapor and other gases through the circulation path, and the gas circulating pump configured to circulate the non-reactive cooling gas through the circulation path;

a heat exchanger coupled to the circulation path;

a non-reactive gas source coupled to the circulation path; and a waste vent coupled to the circulation path; wherein the spent fuel container is configured to receive the non-reactive gas via the at least one inlet path;

the waste vent is configured to receive vapor and gases from the spent fuel container via the circulation path; and the heat exchanger is configured to cool a gas exiting the spent fuel container from the at least one outlet path.

2. The system of claim 1, wherein the circulation pump is configured to create a negative pressure in the spent fuel container relative to the atmospheric pressure when the system is operating in vacuum drying mode.

3. The system of claim 1, wherein the circulation pump is configured to lower a pressure within the spent fuel container when the system is operating in vacuum drying mode.

4. The system of claim 1, wherein the heat exchanger further comprises:

a cooling medium inlet configured to receive a cooling medium entering the heat exchanger;

a cooling medium outlet configured to transport the cooling medium exiting the heat exchanger; and a radioactive waste liquid disposal system configured to transport a radioactive waste liquid from the heat exchanger.

5. The system of claim 1, further comprising at least one heat exchanger shutoff valve system configured to isolate the heat exchanger from the circulation path.

6. The system of claim 1, further comprising a non-reactive gas shutoff valve system configured to isolate the non-reactive gas source from the circulation path.

7. The system of claim 1, further comprising a circulation path shutoff valve system configured to cease circulation of gasses through the circulation path.

8. The system of claim 1, wherein the spent fuel container further comprises a spent fuel canister disposed within a cask, and the at least one inlet path and at least one outlet path are communicatively coupled to the spent fuel canister.

9. The system of claim 1, further comprising a spent fuel container bypass valve system configured to isolate the spent fuel container from the circulation path.

10. The system of claim 1, further comprising a radioactive waste gas disposal system coupled to the circulation path, the radioactive waste gas disposal system configured to remove radioactive waste gas from the circulation path.

11. The system of claim 1, further comprising a circulation path vent configured to vent excess system pressure to another location.

12. The system of claim 1, wherein a non-reactive gas is transported into the spent fuel container via the at least one inlet path and comprises at least one of helium, argon, carbon dioxide, and nitrogen.

13. The system of claim 12, wherein the non-reactive gas further comprises another inert gas.

* * * * *